US009383170B2

(12) United States Patent
Ell

(10) Patent No.: US 9,383,170 B2
(45) Date of Patent: Jul. 5, 2016

(54) LASER-AIDED PASSIVE SEEKER

(71) Applicant: Rosemount Aerospace, Inc., Burnsville, MN (US)

(72) Inventor: Todd Ell, Savage, MN (US)

(73) Assignee: ROSEMOUNT AEROSPACE INC, Burnsville, MN (US)

( * ) Notice: Subject to any disclaimer, the term of this patent is extended or adjusted under 35 U.S.C. 154(b) by 438 days.

(21) Appl. No.: 13/923,923

(22) Filed: Jun. 21, 2013

(65) Prior Publication Data

US 2015/0362290 A1 Dec. 17, 2015

(51) Int. Cl.

| | |
|---|---|
| ***F41G 7/20*** | (2006.01) |
| ***F41G 7/22*** | (2006.01) |
| ***F41G 7/00*** | (2006.01) |
| ***F41G 7/26*** | (2006.01) |

(52) U.S. Cl.

CPC *F41G 7/26* (2013.01); *F41G 7/008* (2013.01); *F41G 7/226* (2013.01); *F41G 7/2253* (2013.01); *F41G 7/2293* (2013.01)

(58) Field of Classification Search

CPC ..... F41G 7/20; F41G 7/22; F41G 7/2253; F41G 7/226; F41G 7/2273; F41G 7/2293; F41G 7/24; F41G 7/26; F41G 7/30; F41G 7/301; F41G 7/308; F41G 7/008; G01S 11/02; G01S 11/04; F42B 15/01

USPC ..... 244/3.1, 3.11, 3.13, 3.15–3.18; 382/100, 103

See application file for complete search history.

(56) References Cited

U.S. PATENT DOCUMENTS

| | | | | |
|---|---|---|---|---|
| 5,855,339 | A * | 1/1999 | Mead | F41G 7/308 244/3.11 |
| 6,111,241 | A | 8/2000 | English et al. | |
| 6,157,875 | A * | 12/2000 | Hedman | F41G 7/2293 244/3.1 |
| 6,347,762 | B1 * | 2/2002 | Sims | F41G 7/2293 244/3.1 |
| 6,987,256 | B2 | 1/2006 | English et al. | |
| 7,394,046 | B2 * | 7/2008 | Olsson | G01S 11/04 244/3.1 |
| 7,858,939 | B2 | 12/2010 | Tener et al. | |

(Continued)

FOREIGN PATENT DOCUMENTS

WO 2012005781 A2 1/2012

OTHER PUBLICATIONS

European Search Report dated Feb. 5, 2015 for European Application No. 14173507.6. (9 pgs).

(Continued)

*Primary Examiner* — Bernarr Gregory

(74) *Attorney, Agent, or Firm* — Cantor Colburn LLP

(57) ABSTRACT

A system to merge and exploit two uniquely different types of seeker homing modes of functionality into a single, dual-mode seeker, using only an FPA as the active sensor to achieve both modes of operation. The disclosed embodiments also provide a means to actively designate & track, and also passively track the same target between active designation pulses to track a target at an update rate higher than the designator pulse rate with less demanding automatic target tracking algorithms. The disclosed embodiments eliminate the need for automatic target acquisition/recognition algorithms necessary for purely passive target tracking. The passive tracking methodology "aids" the passive tracking algorithm, based on frame-to-frame image registration, with active SAL track information to improve overall seeker guided weapon performance.

12 Claims, 3 Drawing Sheets

(56) References Cited

U.S. PATENT DOCUMENTS

| | | | | |
|---|---|---|---|---|
| 8,164,037 | B2 | 4/2012 | Jenkins et al. | |
| 8,525,088 | B1 * | 9/2013 | Ell | F41G 7/2293 244/3.1 |
| 2009/0115654 | A1 | 5/2009 | Lo et al. | |
| 2010/0127174 | A1 | 5/2010 | Tener et al. | |
| 2012/0109538 | A1 * | 5/2012 | Covello | F42B 15/01 244/3.1 |
| 2012/0234966 | A1 | 9/2012 | Biswell | |
| 2012/0248288 | A1 | 10/2012 | Linder et al. | |

OTHER PUBLICATIONS

S. Park, et al., "Super-Resolution Image Reconstruction: A Technical Overview," Signal Processing Magazine, IEEE, vol. 20; No. 3; pp. 21, 36, May 2003.

* cited by examiner

LASER-AIDED PASSIVE SEEKER

REFERENCE TO CO-PENDING APPLICATIONS FOR PATENT

The present application for patent is related to the following co-pending U.S. Patent Applications:

"SEEKER HAVING SCANNING-SNAPSHOT EPA" by Todd A. Ell, having application Ser. No. 13/924,028, filed Jun. 21, 2013, assigned to the assignee hereof, and expressly incorporated by reference herein; and "HARMONIC SHUTTERED SEEKER" by Todd A. Ell and Robert D. Rutkiewicz, having application Ser. No. 13/923,986, filed Jun. 21, 2013, assigned to the assignee hereof, and expressly incorporated by reference herein now U.S. Pat. No. 9,207,053.

FIELD OF DISCLOSURE

The subject matter disclosed herein relates in general to guidance subsystems for projectiles, missiles and other ordinance. More specifically, the subject disclosure relates to the target sensing components of guidance subsystems used to allow ordinance to persecute targets by detecting and tracking energy scattered from targets.

BACKGROUND

Seeker guided ordnances are weapons that can be launched or dropped some distance away from a target, then guided to the target, thus saving the delivery vehicle from having to travel into enemy defenses. Seekers make measurements for target detection and tracking by sensing various forms of energy (e.g., sound, radio frequency, infrared, or visible energy that targets emit or reflect). Seeker systems that detect and process one type of energy are known generally as single-mode seekers, and seeker systems that detect and process multiples types of energy (e.g., radar combined with thermal) are generally known as multi-mode seekers.

Seeker homing techniques can be classified in three general groups: active, semi-active, and passive. In active seekers, a target is illuminated and tracked by equipment on board the ordinance itself. A semi-active seeker is one that selects and chases a target by following energy from an external source, separate from the ordinance, reflecting from the target. This illuminating source can be ground-based, ship-borne, or airborne. Semi-active and active seekers require the target to be continuously illuminated until target impact. Passive seekers use external, uncontrolled energy sources (e.g., solar light, or target emitted heat or noise). Passive seekers have the advantage of not giving the target warning that it is being pursued, but they are more difficult to construct with reliable performance. Because the semi-active seekers involve a separate external source, this source can also be used to "designate" the correct target. The ordinance is said to then "acquire" and "track" the designated target. Hence both active and passive seekers require some other means to acquire the correct target.

In semi-active laser (SAL) seeker guidance systems, an operator points a laser designator at the target, and the laser radiation bounces off the target and is scattered in multiple directions (this is known as "painting the target" or "laser painting"). The ordinance is launched or dropped somewhere near the target. When the ordinance is close enough for some of the reflected laser energy from the target to reach the ordinance's field of view (FOV), a seeker system of the ordinance detects the laser energy, determines that the detected laser energy has a predetermined pulse repetition frequency (PRF) from a designator assigned to control the particular seeker system, determines the direction from which the energy is being reflected, and uses the directional information (and other data) to adjust the ordinance trajectory toward the source of the reflected energy. While the ordinance is in the area of the target, and the laser is kept aimed at the target, the ordinance should be guided accurately to the target.

Multi-mode/multi-homing seekers generally have the potential to increase the precision and accuracy of the seeker system but often at the expense of increased cost and complexity (more parts and processing resources), reduced reliability (more parts means more chances for failure or malfunction), and longer target acquisition times (complex processing can take longer to execute). For example, combining the functionality of a laser-based seeker with an image-based seeker could be done by simple, physical integration of the two technologies; however, this would incur the cost of both a focal plane array (FPA) and a single cell photo diode with its associated diode electronics to shutter the FPA. Also, implementing passive image-based seekers can be expensive and difficult because they rely on complicated and resource intensive automatic target tracking algorithms to distinguish an image of the target from background clutter under ambient lighting. Another factor limiting multi-mode seeker performance is the general incompatibility between the output update rate of a semi-active laser-based seeker system and the output update rate of a passive image-based seeker system. In general, the output update rate from an active laser-based seeker to its guidance subsystem is limited to the PRF of the laser designator (typically from 10 to 20 Hz.), whereas the output update rate of a passive, image-based seeker is limited by the frame rate of its imager and available ambient light (typically greater than 60 Hz.).

Because seeker systems tend to be high-performance, single-use items, there is continued demand to reduce the complexity and cost of seeker systems, particularly multi-mode/multi-homing seeker systems, while maintaining or improving the seeker's overall performance.

SUMMARY

The disclosed embodiments include a laser-aided passive seeker comprising: an imager capable of detecting and decoding laser-based energy and image ambient energy; means for generating from said imager semi-active laser-based images containing a laser spot illuminating a target; means for generating from said imager passive ambient-energy images containing said target without said laser spot; means for updating said means for generating said semi-active laser-based images; and means for using said passive images and said means for updating to passively track said target.

The disclosed embodiments further include a method of laser-aided passive tracking comprising: detecting and decoding laser-based energy and image ambient energy at a single imager; generating from said imager semi-active laser-based images containing a laser spot illuminating a target; generating from said imager passive ambient energy-based images containing said target without said laser spot; updating said step of generating said semi-active laser-based images; and using said passive image-based images and said step of updating to passively track said target.

BRIEF DESCRIPTION OF THE DRAWINGS

The accompanying drawings are presented to aid in the description of embodiments of the invention and are provided solely for illustration of the embodiments and not limitation thereof.

Figure 1:
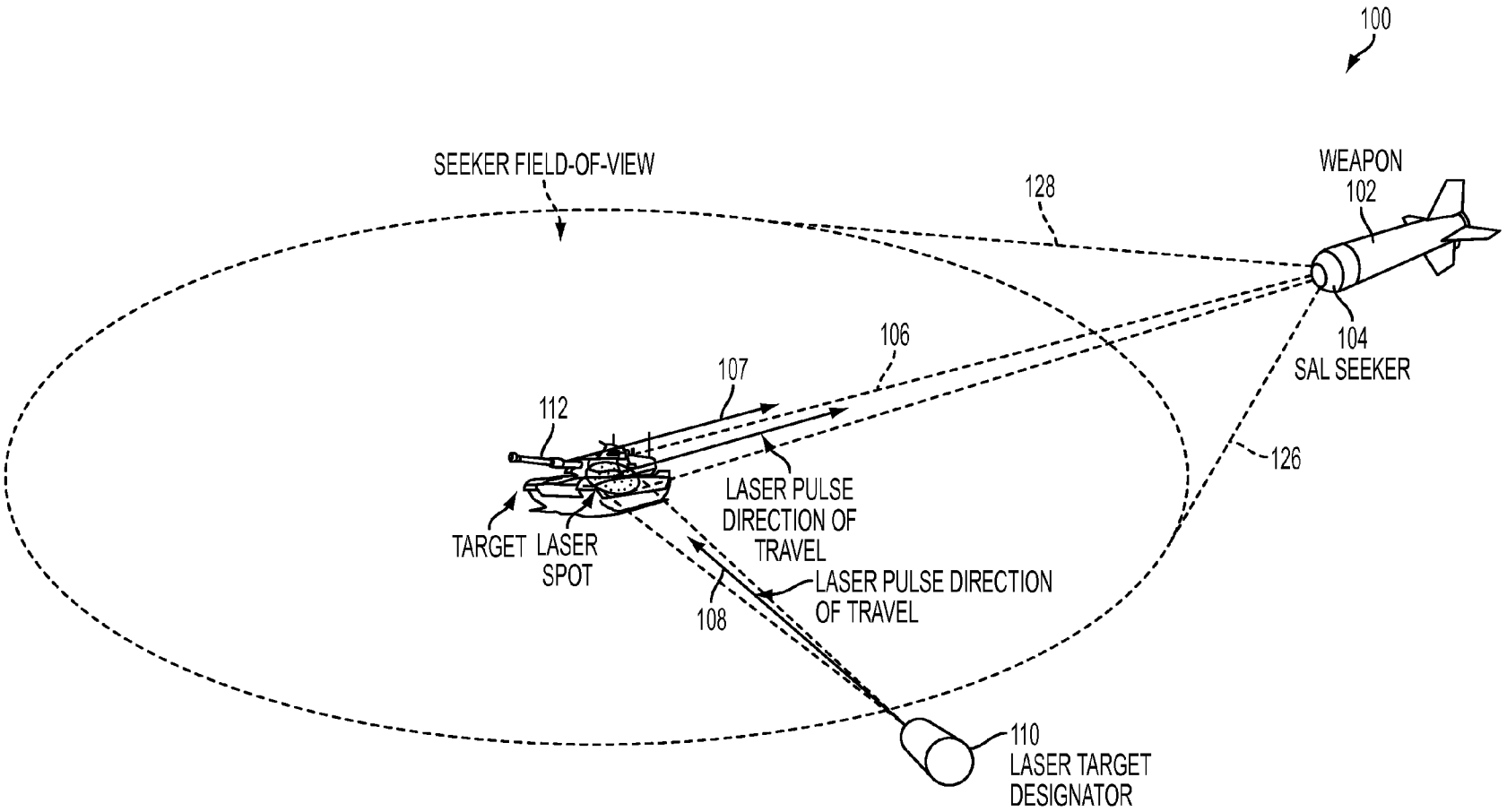
FIG. 1 is a schematic illustration of a seeker guided projectile engaging a target.

In the accompanying figures and following detailed description of the disclosed embodiments, the various elements illustrated in the figures are provided with three-digit reference numbers. The leftmost digit of each reference number corresponds to the figure in which its element is first illustrated.

DETAILED DESCRIPTION

Aspects of the invention are disclosed in the following description and related drawings directed to specific embodiments of the invention. Alternate embodiments may be devised without departing from the scope of the invention. Additionally, well-known elements of the invention will not be described in detail or will be omitted so as not to obscure the relevant details of the invention.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Further, many embodiments are described in terms of sequences of actions to be performed by, for example, elements of a computing device. It will be recognized that various actions described herein can be performed by specific circuits (e.g., application specific integrated circuits (ASICs)), by program instructions being executed by one or more processors, or by a combination of both. Additionally, the sequence of actions described herein can be considered to be embodied entirely within any form of computer readable storage medium having stored therein a corresponding set of computer instructions that upon execution would cause an associated processor to perform the functionality described herein. Thus, the various aspects of the invention may be embodied in a number of different forms, all of which have been contemplated to be within the scope of the claimed subject matter. In addition, for each of the embodiments described herein, the corresponding form of any such embodiments may be described herein as, for example, "logic configured to" perform the described action.

Turning now to an overview of the disclosed embodiments, an important performance parameter for seeker systems, particularly multi-mode/multi-homing systems, includes how quickly, reliably and efficiently the seeker system detects, decodes and localizes the laser designator energy it receives in its FOV. In the present disclosure, the term "detect," when used in connection with reflected laser energy, generally refers to sensing energy from an unknown target. The term "decode" refers to verifying that a PRF of the detected laser energy matches the pre-determined, expected PRF of the projectile/designator pair. The term "localize" refers to resolving where the detected, decoded energy occurs in the FOV.

The disclosed embodiments take advantage of the capability to merge two uniquely different types of seeker homing modes of functionality (e.g., semi-active laser-based and passive image-based) into a single, dual-mode/dual-homing seeker, using only an FPA as the active sensor to achieve both modes of operation. Examples of suitable seeker designs are disclosed in the following co-pending U.S. patent applications: "SEEKER HAVING SCANNING-SNAPSHOT FPA" by Todd A. Ell, having application Ser. No. 13/924,028, filed Jun. 21, 2013, assigned to the assignee hereof, and expressly incorporated by reference herein; and "HARMONIC SHUTTERED SEEKER" by Todd A. Ell and Robert D. Rutkiewicz, having application Ser. No. 13/923,986, filed Jun. 21, 2013, assigned to the assignee hereof, and expressly incorporated by reference herein now U.S. Pat. No. 9,207,053.

As weapons become more agile, and as there is an increased emphasis on hit placement performance, the seeker system's output update rate becomes one limiting factor in the overall weapon performance. The seeker output update rate from a semi-active, laser-based seeker to its guidance subsystem is limited to the PRF of the laser designator (typically 10 to 20 Hz.), whereas the output update rate of a passive, image-based seeker is limited by the frame rate of the imager and available ambient light (typically greater than 60 Hz.). The methods and structures of the disclosed embodiments provide seeker outputs at a rate consistent with a passive image-based seeker, yet does not demand the computational resources that are typically required by conventional automatic target acquisition, recognition, and tracking.

FIG. 1 is a schematic diagram of a seeker guided ordinance system 100 capable of utilizing the disclosed embodiments. As shown in FIG. 1, a precision guided ordinance (shown as a projectile 102) may engage a target 112 by using a seeker system 104 of the ordinance/projectile 102 to detect and follow energy 106, 107 that has been reflected from the target 112 into the sensor system's field-of-view (FOV). The sensor system's FOV is generally illustrated in FIG. 1 as the area between directional arrows 126, 128. The reflected energy may be laser energy 106 or some other energy 107 (e.g. ambient light for deriving an image). The seeker system 104 may be equipped with sufficient sensors and other electro-optical components to detect energy in various portions of the electromagnetic spectrum, including the visible, infrared (IR), microwave and millimeter wave (MMW) portions of the spectrum. The seeker system 104 may incorporate one or more sensors that operate in more than one portion of the spectrum. Single-mode implementations of the seeker system 104 utilize only one form of energy to detect, locate and localize the target 112. Multi-mode implementations of the seeker system 104 utilize more than one form of energy to detect, locate and localize the target 112. In the present disclosure, the term "detect," when used in connection with reflected laser energy, generally refers to sensing energy from an unknown target. The term "decode" refers to verifying that a PRF of the detected laser energy matches the pre-determined, expected PRF of the projectile/designator pair. The term "lock" refers to time synchronization of the pulse occurrence with a seeker clock. The term "localize" refers to resolving where the detected, decoded laser energy occurs in the sensor system's FOV (126, 128).

Continuing with FIG. 1, the target 112 is shown in FIG. 1 as a military tank but may be virtually any object capable of reflecting energy, including for example another type of land vehicle, a boat or a building. For laser-based implementations, the target 112 may be illuminated with laser energy 108 from a laser designator 110. The laser designator 110 may be located on the ground, as shown in FIG. 1, or may be located in a vehicle, ship, boat, or aircraft. The designator 110 transmits laser energy 108 having a certain power level, typically measured in milli-joules/pulse, and a certain PRF, typically measured in hertz. Each designator 110 and projectile 102 set is provided with the same, unique PRF code. For laser-based implementations, the seeker system 104 must identify from among the various types of detected energy reflected laser energy 106 having the unique PRF assigned to the projectile 102 and designator 110 pair. Laser-based seeker systems are generally referred to as "semi-active" seekers because they require that a target is actively illuminated with laser energy in order to detect, decode and localize the target. Image-based seeker systems known as "passive" track targets using uncontrolled illumination sources (i.e., solar energy) and relatively complicated and potentially costly automatic target tracking algorithms and processing resources to distinguish an image of the target from background clutter under ambient lighting. Thus, the seeker system 104, which may be equipped with single-mode, multi-mode, active and/or passive homing functionality, uses information (e.g., PRF, an angle of incidence, images) derived from the reflected energy 106, 107, along with other information (e.g., GPS coordinates), to identify the location of the target 112 and steer the projectile 102 to the target 112.

Figure 2:
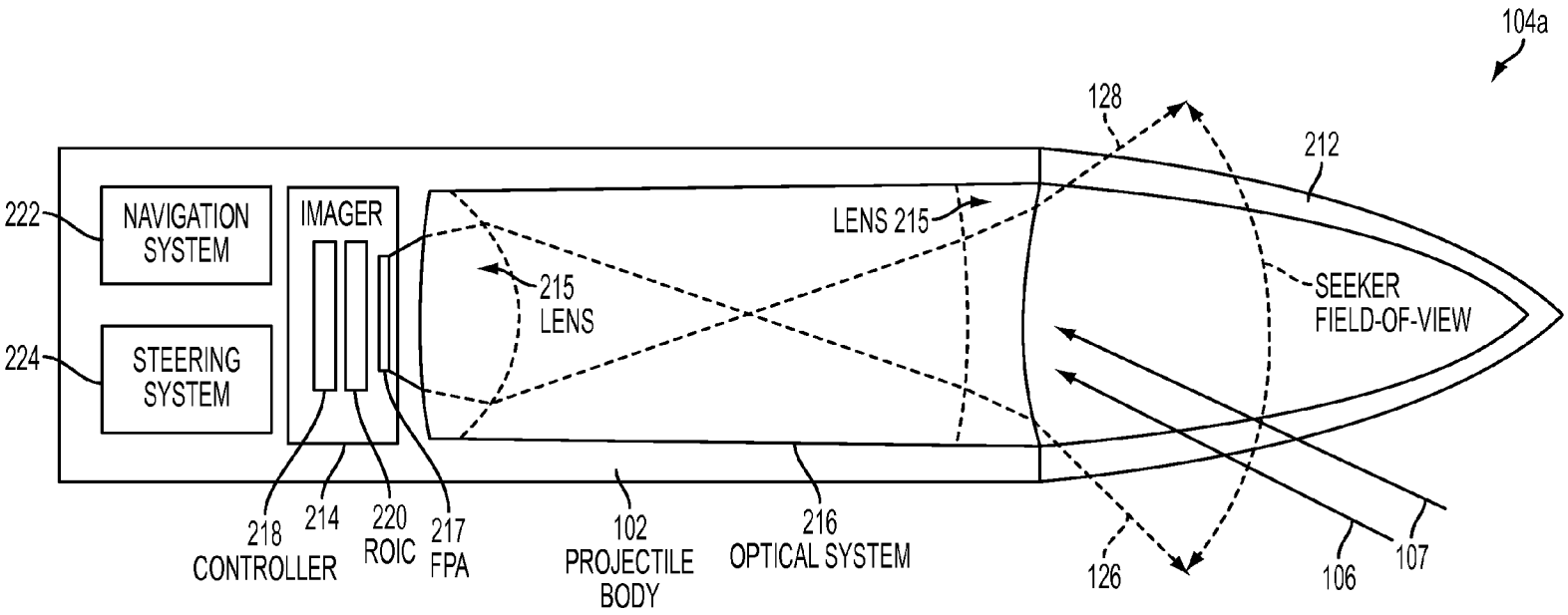
FIG. 2 is a high level block diagram showing additional details of a seeker system of the disclosed embodiments, wherein only an FPA is used as the active sensor to achieve both the semi-active laser and the passive modes of homing operation.

FIG. 2 is a block diagram illustrating a seeker system 104*a* of the disclosed embodiments. Seeker system 104*a* corresponds to the seeker system 104 shown in FIG. 1, but shows additional details of how the seeker system 104 may be modified to provide a single imager 214, which is preferably a shortwave infrared (SWIR) imager or its equivalent, that is capable of capturing both laser and ambient-energy image data through a single FPA 217 of the imager. The FPA 217 may be constructed of InGaAs, such as $In_{0.53}Ga_{0.47}As$. In some embodiments, the FPA 217 may be constructed according to the materials and methods disclosed in U.S. Pat. Nos. 6,573,581 and/or 6,489,635, each of which is incorporated herein by reference in its entirety. In accordance with the previously described, co-pending and commonly assigned U.S. patent applications, the FPA 217 is configured and arranged to be sensitive to the typical wavelengths of laser target designators. As such, imager 214 can detect the laser radiation reflected from a target. The previously described, co-pending and commonly assigned U.S. patent applications disclose means for synchronizing the imager's shutter or exposure time with the reflected laser pulse to ensure the laser pulse is captured in the image. In contrast, a non-SWIR imager is not sensitive to laser light and requires a separate sensor to capture laser light and integrate its location in the field-of-view with target location in the non-SWIR image. The above-described reflected laser energy captured by an imager is referred to herein as "semi-active laser" (SAL) energy, and the captured images containing the laser spot are referred to herein "semi-active images" (SAI). Therefore, the frame rate of the imager 214 may be configured to match the pulse repetition interval (PRI) of the laser designator 110 (shown in FIG. 1) (i.e., the frame rate=1/PRI).

Thus, the seeker system 104*a* of FIG. 2 is capable of providing multi-mode (broad-band ambient energy and narrow band laser energy) and multi-homing (semi-active and passive) functionality and includes a seeker dome 212, an imager 214, a navigation system 222 and a steering system 224. The seeker dome 212 includes a FOV identified by the area between arrows 126, 128. Reflected laser energy 106 and other energy 107 (e.g., ambient light or image energy) within the FOV 126,128 may be captured by the seeker system 104*a*. The imager 214 includes an optical system 216 having a lens system 215, a readout integrated circuit (ROIC) 220 and control electronics 218. The imager 214 includes a detector that is preferably implemented as the single FPA 217. The imager components (217, 218 and 220), along with the optical components (215, 216), are configured and arranged as described above to focus and capture incoming energy (e.g., reflected laser energy 106 and/or ambient light energy 107). The FPA 217 and ROIC 220 convert incoming laser or ambient light energy 106, 107 to electrical signals that can then be read out and processed and/or stored. The control electronics stage 218 provides overall control for the various operations performed by the FPA 217 and the ROIC 220 in accordance with the disclosed embodiments. The imager 214 generates signals indicative of the energy 106, 107 received within the imager's FOV (126, 128), including signals indicative of the energy's PRF and the direction from which the pulse came. The navigation system 222 and steering system 224 utilize data from the imager 214, along with other data such as GPS, telemetry, etc., to determine and implement the appropriate adjustment to the flight path of the projectile 102 to guide the projectile 102 to the target 112 (shown in FIG. 1). Although illustrated as separate functional elements, it will be understood by persons of ordinary skill in the relevant art that the various electro-optical components shown in FIG. 2 may be arranged in different combinations and implemented as hardware, software, firmware, or a combination thereof without departing from the scope of the disclosed embodiments.

Figure 3:
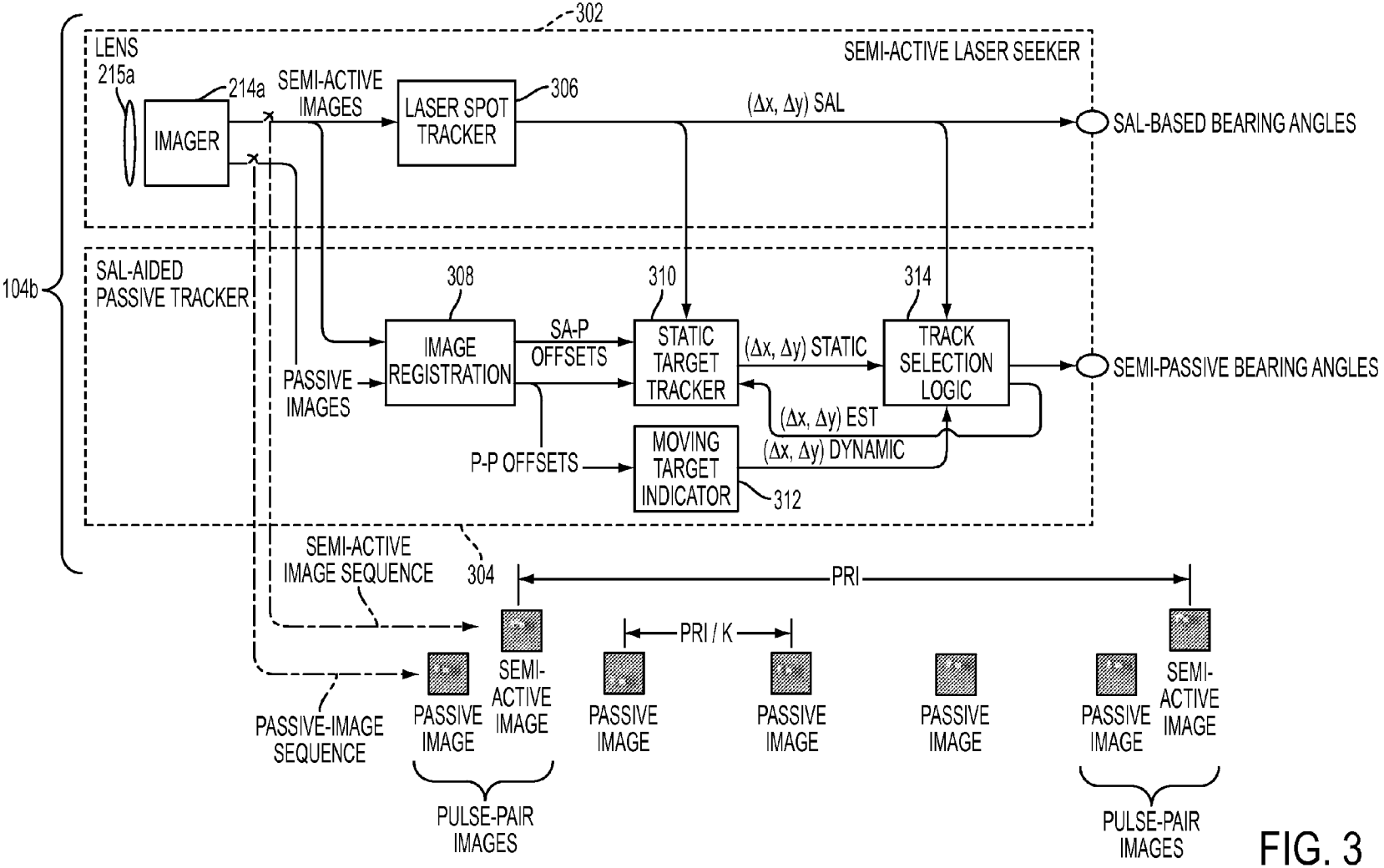
FIG. 3 is a schematic illustration of a combined semi-active laser seeker and a passive image-based seeker of the disclosed embodiments, wherein the semi-active seeker "aids" the passive tracker.

FIG. 3 is a block diagram illustrating additional details of a laser-aided passive seeker system 104*b* of the disclosed embodiments. The laser-aided passive seeker system 104*b* corresponds generally to the seeker system 104*a* shown in FIG. 2, but shows additional details of how the seeker system 104*b* uses a single imager 214*a*, which is preferably a SWIR imager or its equivalent, to implement a semi-active, laser-based SAL seeker system 302 working in tandem with and a SAL-aided passive tracker 304. The tracker system 304 is described as SAL-aided because of interaction between the passive and active modes of the seeker system 104*b*, as will be described in more detail herein. As previously described, the reflected laser energy captured by an imager is referred to herein as "semi-active laser" (SAL) energy, and the captured images containing the laser spot are referred to herein "semi-active images" (SAI). Therefore, the frame rate of the imager 214*a* is configured to match the pulse repetition interval (PRI) of the laser designator 110 (shown in FIG. 1) (i.e., the frame rate=1/PRI). Using the location of the laser spot in the FOV, the bearing angle to the target 112 (shown in FIG. 1) is determined by measuring the pixel offset ($\Delta x$, $\Delta y$) SAL from the center of the FPA 217 (shown in FIG. 2), which corresponds to zero bearing angles (both horizontal and vertical).

The imager 214*a* is configured to also capture images at an integer subdivision of the PRI. These additional images are intended to be passive-only images meaning they will intentionally not capture the laser pulses. This avoids potential problems with the passive tracker's moving target indicator 312 (described below), which would be sensitive to rapid changes in illumination. These images are referred to as "passive images." Also, the first passive image of each PRI interval is captured close in time to the SAL image. The close time proximity is typically less than about 10 milli-seconds between exposures. However, it should be noted that this number is inversely proportional to the amount of ego-motion, e.g., angular rotation of the projectile. The relatively close time proximity is done to minimize the changes in the FOV between the SAL image and the passive image. This allows the laser spot coordinates $(\Delta x, \Delta y)_{SAL}$ from the semi-active image (SAI) to be mapped directly onto the passive image. This pair of images is referred to as a "pulse-pair" of images. The resulting image sequence from the imager 214*a* is depicted at the bottom of FIG. 3.

The seeker system 104*b* includes a SAL seeker stage 302, along with a SAL-aided passive tracker stage 304. The SAL-aided stage 304 includes an image registration stage 308, a static target tracker stage 310, a moving target indicator stage 312, and a track selection logic stage 314. Image registration 308 is the process of overlaying two images of the same scene taken at different times, and from different viewpoints. It geometrically aligns two images, which, for the disclosed embodiments are the reference and current images. The image registration stage 308 searches for the correct scale, translation, rotation, etc. that will align a portion of the current image to a portion of the reference image. When a match is found, the images are said to have been "registered." The image registration stage 308 registers sequential images from the laser imager 214*a* and outputs the offsets between the two images required to register them. These outputs are denoted as SA-P offsets and P-P offsets, respectively, if the offsets are between semi-active & passive images or passive & passive images. The image registration stage 308 also results in transform model estimation (i.e., the change in location, rotation, translation of the imager) used to align the reference and current image. Multiple image registration algorithms exist in industry. One such algorithm is the Affine Scale Invariant Feature Transform (ASIFT) method by Guoshen Yu and Jean-Michel Morel; Guoshen Yu; Morel, J-M, *A Fully Affine Invariant Image Comparison Method*, Acoustics, Speech and Signal Processing, 2009. ICASSP 2009. IEEE International Conference on, vol., no., pp. 1597,1600, 19-24 Apr. 2009. Another algorithm is the Features from Accelerated Segment Test (FAST) feature detector by Rosten, Edward, and Tom Drummond, described in *Fusing Points and Lines for High Performance Tracking*; Computer Vision, 2005. ICCV 2005, Tenth IEEE International Conference on, vol. 2, pp. 1508-1515, IEEE, 2005. The entire disclosures of the above publications are incorporated by reference herein.

Using the initial laser spot coordinates $(\Delta x, \Delta y)_{SAL}$ of the pulse-pair, SAI, the static target tracker stage 310 uses the registration offset and transform model estimation to track this location across all the passive images until the next semi-active image is captured. As long as the target does not move on the ground, the passively tracked point, from image to image, will correspond to the target. This track point is denoted $(\Delta x, \Delta y)_{static}$. It should be noted that the static target tracker 310 is not registering the image of the target alone. It is registering the entire FOV from one image to the next so that the target pixels need not be separated from the background. The reason for creating closely timed pulse-pair images is because the exposure time of the semi-active images may be too short to capture background contrast so that the laser spot can be located in the laser spot tracker component. Hence, the pulse-pair of images may fail the registration process. In event of a registration failure, the $(\Delta x, \Delta y)$ static is set equal to $(\Delta x, \Delta y)_{SAL}$. Thus, the pulse-pair frame rate is preferably sufficiently high to minimize the error when mapping between these two images.

The moving target indicator stage 312 creates an image of changes between two views by registering sequential passive images and subtracting overlapping pixel values. Looking at the time evolution of these changes from image to image allows for the detection of objects in motion within the FOV. This can be accomplished using known optical flow techniques. The extent and location of these moving objects are reported to the track selection logic stage 314. Only those objects overlapping or close to the statically tracked point from the static target tracker stage 314 need be reported. These track points, if they exist, are denoted $(\Delta xi, \Delta yi)_{dynamic}$. The track selection logic stage 314 uses the tautology (i.e., a statement that is always true) "a target is either moving or it is not" to determine if the actual target is determined by the static target tracker stage 310 or the moving target indicator stage 312. If a moving track point $(\Delta xi, \Delta yi)_{dynamic}$ exists and overlaps or is close enough to the static track point $(\Delta xi, \Delta yi)_{static}$, then the moving track point is the actual target. Thus, the actual target estimate $(\Delta x, \Delta y)_{est}$, follows the moving target track. If the target stops its motion, then the last known location becomes the new static track point static tracked by the static target tracker stage 310, which tracks this new point with respect to the entire background within the FOV. This situation of switching between the static & moving tracks continues until a new SAL track point $(\Delta x, \Delta y)_{SAL}$ arrives from the SAL-seeker 302 where the whole process is re-started.

Accordingly, it can be seen from the foregoing disclosure and the accompanying illustrations that one or more embodiments may provide some advantages. For example, the disclosed embodiments allow for the merging and exploitation of two uniquely different types of seeker functionality into a single, dual-homing seeker, using only an FPA as the active sensor to achieve both modes of homing operation. The disclosed embodiments also provide a means to actively designate & track, and also passively track the same target between active designation pulses to track a target at an update rate higher than the designator pulse rate with less demanding automatic target tracking algorithms. Further, the disclosed embodiments also eliminate the need for automatic target acquisition/recognition algorithms necessary for purely passive target tracking. The disclosed embodiments "aid" the passive tracking algorithm, based on frame-to-frame image registration, with active SAL track information to improve overall seeker guided weapon performance. The disclosed passive tracker is sufficiently robust that the system can be configured to, in the event the laser designator is turned off and/or lost, revert automatically to passive-only homing mode (without laser-aiding) making it possible for the designator operator to "designate-and-forget" instead of having to "designate-to-impact."

Those of skill in the relevant arts will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill in the relevant arts will also appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosed embodiments.

Finally, the methods, sequences and/or algorithms described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. Accordingly, the disclosed embodiments can include a computer readable media embodying a method for performing the disclosed and claimed embodiments. Accordingly, the invention is not limited to illustrated examples and any means for performing the functionality described herein are included in the disclosed embodiments. Furthermore, although elements of the disclosed embodiments may be described or claimed in the singular, the plural is contemplated unless limitation to the singular is explicitly stated. Additionally, while various embodiments have been described, it is to be understood that aspects of the embodiments may include only some aspects of the described embodiments. Accordingly, the disclosed embodiments are not to be seen as limited by the foregoing description, but are only limited by the scope of the appended claims.

What is claimed is:

1. A laser-aided semi-passive seeker comprising:

a semi-active laser seeker having an imager configured to detect and decode laser-based energy and image ambient energy;

said imager further configured to generate at a first predefined rate a sequence of semi-active laser-based images containing a laser spot illuminating a target;

said imager said imager further configured to generate at a second predefined rate a sequence of passive ambient-energy images containing said target without said laser spot;

a laser-aided semi-passive tracker configured to receive said sequence of semi-active laser-based images at said first predefined rate;

said laser-aided semi-passive tracker further configured to receive said sequence of passive ambient-energy images at said second predefined rate;

said laser-aided semi-passive tracker further configured to process an image pair comprising one of said sequence of semi-active laser-based images received within a predetermined time of one of said sequence of passive ambient-energy images in order to map laser spot coordinates of said laser spot of said one of said sequence of semi-active laser-based images to said one of said sequence of passive ambient-energy images; and said laser-aided semi-passive tracker further configured to track said laser spot coordinates on said sequence of passive ambient-energy images that are not received by said laser-aided semi-passive tracker within said predetermined time of said one of said sequence of said semi-active laser based images.

2. The seeker of claim 1 wherein said predetermined time comprises less than about 10 milli-seconds.

3. The seeker of claim 1 further comprising an image registration stage configured to register said sequence of active laser-based images with said sequence of passive images.

4. The seeker of claim 3 wherein said image registration stage registers said sequence of active laser-based images with said sequence of passive images by a frame-to-frame image registration.

5. The seeker of claim 1 wherein said laser-aided semi-passive tracker tracking said laser spot coordinates on said sequence of passive ambient-energy images that are not received by said laser-aided semi-passive tracker within said predetermined time of said one of said sequence of said semi-active laser based images designates said target for semi-passive tracking of said target.

6. The seeker of claim 1 wherein said said laser-aided semi-passive tracker automatically reverts to a passive-only homing mode if receipt of said laser spot coordinates is discontinued.

7. A computer implemented method of laser-aided semi-passive tracking comprising:

detecting and decoding, using a processor system, laser-based energy and image ambient energy at a single imager;

generating, using said processor system, from said imager at a first predetermined rate a sequence of semi-active laser-based images containing a laser spot illuminating a target;

generating, using said processor system, from said imager at a second predetermined rate a sequence of passive ambient energy-based images containing said target without said laser spot;

receiving at a laser-aided semi-passive tracker said sequence of semi-active laser-based images at said first predefined rate;

receiving at said laser-aided semi-passive tracker said sequence of passive ambient-energy images at said second predefined rate;

processing by said laser-aided semi-passive tracker an image pair comprising one of said sequence of semi-active laser-based images received within a predetermined time of one of said sequence of passive ambient-energy images in order to map laser spot coordinates of said laser spot of said one of said sequence of semi-active laser-based images to said one of said sequence of passive ambient-energy images; and tracking by said laser-aided semi-passive tracker said laser spot coordinates on said sequence of passive ambient-energy images that are not received by said laser-aided semi-passive tracker within said predetermined time of said one of said sequence of said semi-active laser based images.

8. The method of claim 7 wherein said predetermined time comprises less than about 10 milli-seconds.

9. The method of claim 7 further comprising registering using an image registration stage said sequence of active laser-based images with said sequence of passive images.

10. The method of claim 9 wherein said registering comprises frame-to-frame image registration.

11. The method of claim 7 further comprising the step of using said sequence of semi-active laser-based images to designate said target for semi-passive tracking of said target.

12. The method of claim 7 further comprising the step of automatically reverting to a passive-only horning mode if receipt of said laser spot coordinates is discontinued.

* * * * *